US005570470A

United States Patent [19]

Miller

[11] Patent Number: 5,570,470

[45] Date of Patent: Nov. 5, 1996

[54] LEG PROTECTION DEVICE

[76] Inventor: Kent M. Miller, 5127 Shotwell St., Woodstock, Ga. 30188

[21] Appl. No.: 497,525

[22] Filed: Jul. 3, 1995

[51] Int. Cl.[6] ..... A41D 13/00

[52] U.S. Cl. ..... 2/22

[58] Field of Search ..... 2/22, 24, 16

[56] References Cited

U.S. PATENT DOCUMENTS

| | | | |
|---|---|---|---|
| 3,648,291 | 3/1972 | Pankers | 2/22 X |
| 4,001,953 | 1/1977 | Fugere et al. | 2/22 X |
| 4,926,501 | 5/1990 | Goosen | 2/22 |
| 5,173,697 | 12/1992 | Carter | 2/242 |
| 5,301,370 | 4/1994 | Henson | 2/22 |
| 5,307,521 | 5/1994 | Davis | 2/22 |
| 5,384,913 | 1/1995 | Hendry | 2/2 |

FOREIGN PATENT DOCUMENTS

| | | | |
|---|---|---|---|
| 724722 | 2/1955 | United Kingdom | 2/22 |

*Primary Examiner*—Paul C. Lewis
*Attorney, Agent, or Firm*—Hopkins & Thomas

[57] ABSTRACT

A rectangular, flexible, impervious body is provided, on its inside, with unwoven fibrous lining. The body is formed of a vinyl sheet and has a shin protector pad along the central longitudinal portion of the body. This shin protector is retained in a pocket formed by an overlay which cooperates with the body for confining the pad in a pocket. Velcro® straps cooperate with each other and are secured to the edge portions of the rectangular body so that, when the legging is wrapped around the leg of a person, portions of the straps will overlap and removably join together.

14 Claims, 2 Drawing Sheets

LEG PROTECTION DEVICE

FIELD OF THE INVENTION

This invention relates to a legging, and is more particularly concerned with a leg protection device for use primarily by gardeners and those in the horticultural field.

DESCRIPTION OF THE PRIOR ART

In the past, numerous devices have been devised for protecting a person's leg from damage. Usually such devices are used primarily in the athletic field. A leg and arm protector is disclosed in U.S. Pat. No. 5,173,967 issued Dec. 29, 1992 to James E. Carter. This patent discloses the single piece of material which is designed to wrap around the leg or arm of a person so as to protect the leg or arm against harmful chemicals. This patent shows a hock and pile closure sewn in comers of the top and bottom and also along the lateral edges of the body, to provide the user with full or partial protection from anything that would penetrate. The patent points out that no metal strips for support or other heavy objects is required in the construction of this device.

SUMMARY OF THE INVENTION

Briefly described, the present invention includes a rectangular, flexible, impervious sheet of plastic material which forms a body or web of the legging, this body being of a length and width to wrap around substantially the entire length of a person's lower leg, between the knee and the ankle. Disposed in spaced relationship along opposite sides of the flexible body are a plurality of straps or tabs formed, in part, of hook and pile fabric, known as Velcro®. Opposed pairs of these straps are urged together when the body is wrapped around the leg of a person so that the legging is removably retained on the leg. Preferably, the body has an inner lining formed of strands of cotton or polyester fibers adhered to the inner surface of the body.

Along the inner central surface of the body is a flexible, smaller, inner sheet or overlay forming, with the body, a longitudinal pocket receiving a length of foamed padding, extending generally parallel to the edges of the plastic web, throughout substantially the length of the body. When the plastic body is wrapped around the lower limb or leg of a person's body, the inner sheet, covering the foamed padding, contacts the shin of a person so as to protect the shin against being readily injured.

Accordingly, it is an object of the present invention to provide a legging for protecting the lower limb or leg of a person, the legging being inexpensive to manufacture, durable in structure and efficient in operation.

Another object of the present invention is to provide a legging which may be readily installed and removed from the lower leg of a person.

Another object of the present invention is to provide a legging which can be selectively installed directly on the leg of a person or over the trouser leg of the person.

Another object of the present invention is to provide a legging which will readily and easily protect the shin of the wearer.

Another object of the present invention is to provide a legging which can be readily produced, without expensive or intricate tools from inexpensive material.

Another object of the present invention is to provide a legging which will effectively protect the lower leg of a gardener or horticulturalist against injury while he is walking through underbrush and while he is in a kneeling position on the ground or on rocks.

Another object of the present invention is to provide a legging which can be easily installed by a wearer and easily removed from the wearer.

Another object of the present invention is to provide a legging which is comfortable when worn, and easily adjusted to fit different diameter, lower legs.

Other objects, features and advantages of the present invention will become apparent from the following description when considered in conjunction with the accompanying drawings, wherein like characters of reference designate corresponding parts throughout the several views.

DETAILED DESCRIPTION OF THE INVENTION

Figure 1:
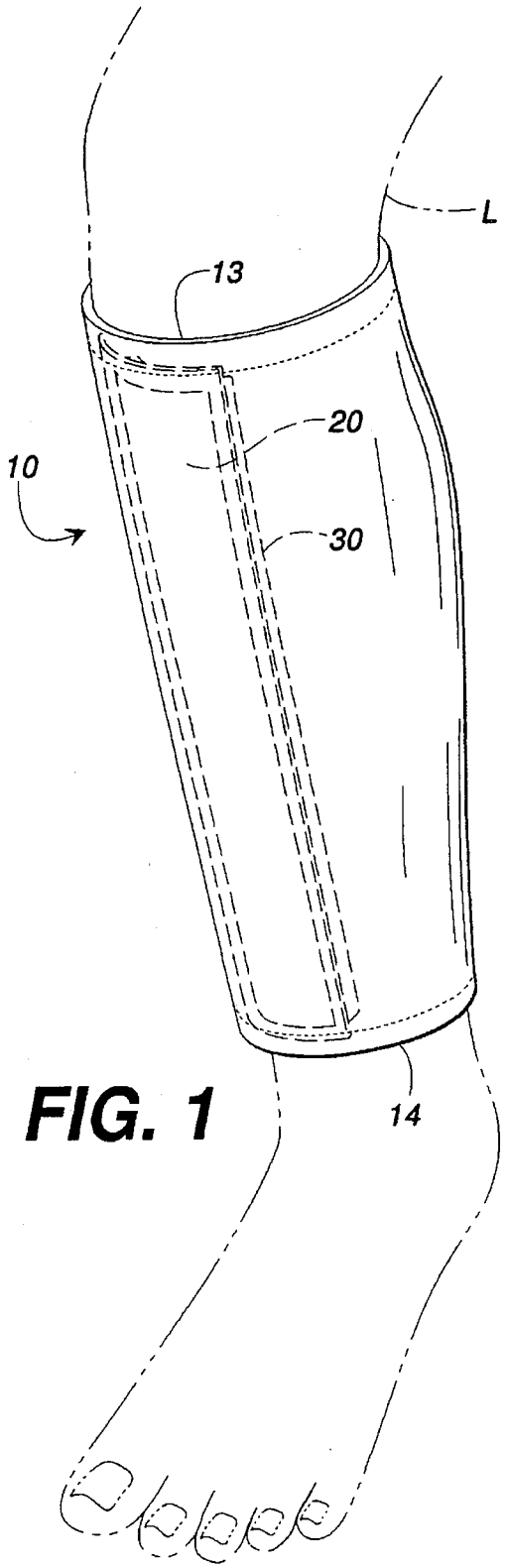
FIG. 1 is a perspective view of the legging of the present invention being applied to a person's lower leg, the person's lower leg being shown in broken lines.

Referring now in detail to the embodiment chosen for purpose of illustrating the preferred embodiment of the present invention, numeral 10 denotes generally the body or web of the legging of the present invention. This body 10 is preferably made from a flexible, rectangular sheet of polyvinyl chloride plastic (vinyl plastic) which forms a water resistant, impervious web of a sufficient width to wrap around substantially the central lower leg of a person and a sufficient height that it covers the leg L (FIG. 1) from the knee down to the ankle. This rectangular web or body 10 includes an outer surface 11, an inner surface 12, an upper edge 13, a lower edge 14, a side edge 15 and a second side edge 16 which is opposed to and generally parallel to the side edge 15. The web or body 10 is quite flexible and therefore will readily wrap around a portion of or all of the lower limb of leg L of a person's leg. Indeed, the dimensions of the body 10 are such that the web will readily wrap around a leg of a person over his pant leg, the body 10 passing outwardly around this pant leg (not shown). If desired, the body may be made of canvas.

Forming the inner surface 12 of the web 10 is a fibrous, absorbent, soft lining or backing 17 of non-woven cotton or polyester fibers, the function of which is to protect a person's leg L from being irritated when the leg L moves with respect to the legging. This lining 17 is adhered to the inner surface 12 of the body 10 and provides warmth, when the legging is worn in cold weather, and also functions to absorb perspiration.

The edges 13, 14, 15 and 16 are folded back and stitched in place to provide narrow hems or folds 13*a*, 14*a*, 15*a* and 16*a*, respectively. The threads 13*b*, 14*b*, 15*b*, and 16*b* hold these hems or folds 14*a*, 15*a*, and 16*a* in place, along the back side of body 10 to define with the edge portions of body 10, a rectangular perimeter in which the top and bottom edges 13 and 14 are parallel to each other and the side edges 15 and 16 are parallel to each other.

Disposed longitudinally along the central portion of inner surface 12 of the web 10 is an elongated, rectangular, parallelepiped, shin protector pad or padding 20 which is preferably formed of a resilient material, such as foam plastic padding. The shin protector padding 20 extends essentially the entire length of the inner surface 12 of the web 10, terminating so that its upper end 21 is inwardly of edge 13 and its lower end 22 is inwardly of the lower edge 14 of the web or sheet 10. The padding 20 has parallel side edges 23 and 24 which are also parallel to the side edges 15 and 16 of the web 10. These edges 23 and 24, however, are spaced inwardly of edges 16 and 17, respectively, so that only the central portion of the side 12 of the web 10 is covered by the padding 20.

Shin protector padding 20 is received in a pocket formed by a flexible, rectangular, shin protector overlay 30, preferably of a sheet of plastic, such as the polyvinyl chloride body 10. This overlay 30 is larger than the shin protector padding 20, in all dimensions, thereby enabling the overlay 30 to extend outwardly of the shin protector padding 20 and provides a perimeter or peripheral portion which is stitched to or otherwise adhered to side 12 of sheet 10. Thus, the combination of the shin protector overlay 30 and the body 10 forms the elongated, rectangular central pocket, within which the shin protector pad or padding 20 is confined and holds the shin protector pad 20 in a fixed position.

Figure 2:
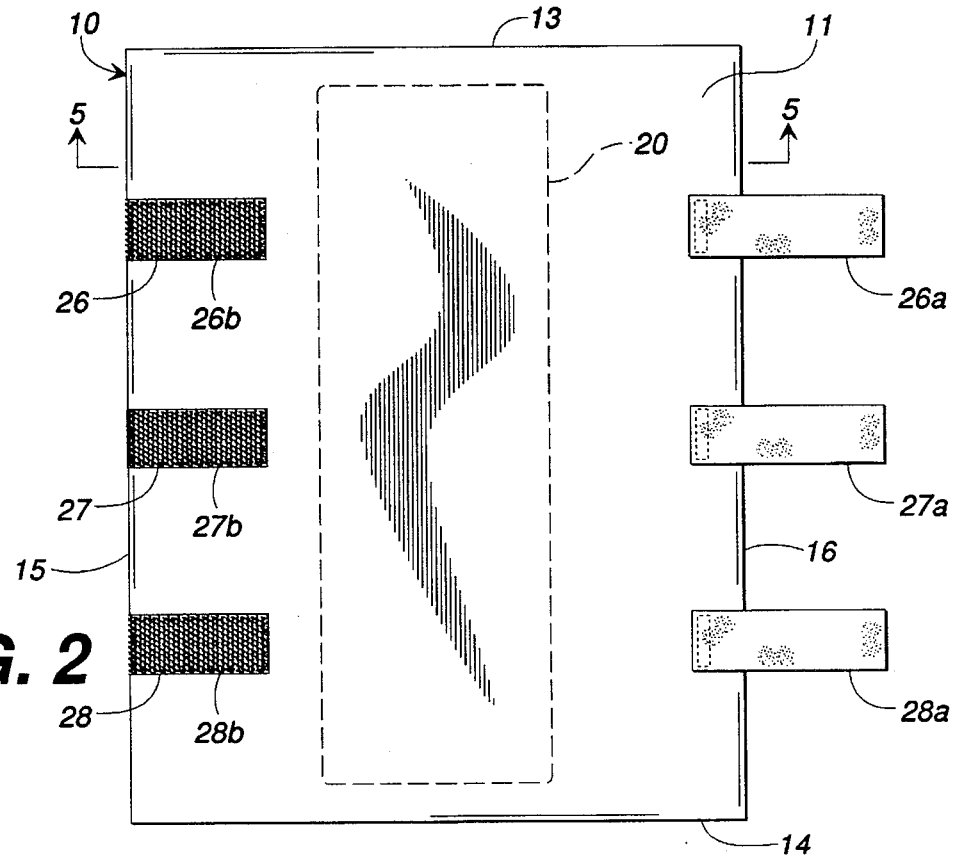
FIG. 2 is a plan view of the front side of the legging illustrated in FIG. 1.
Figure 4:
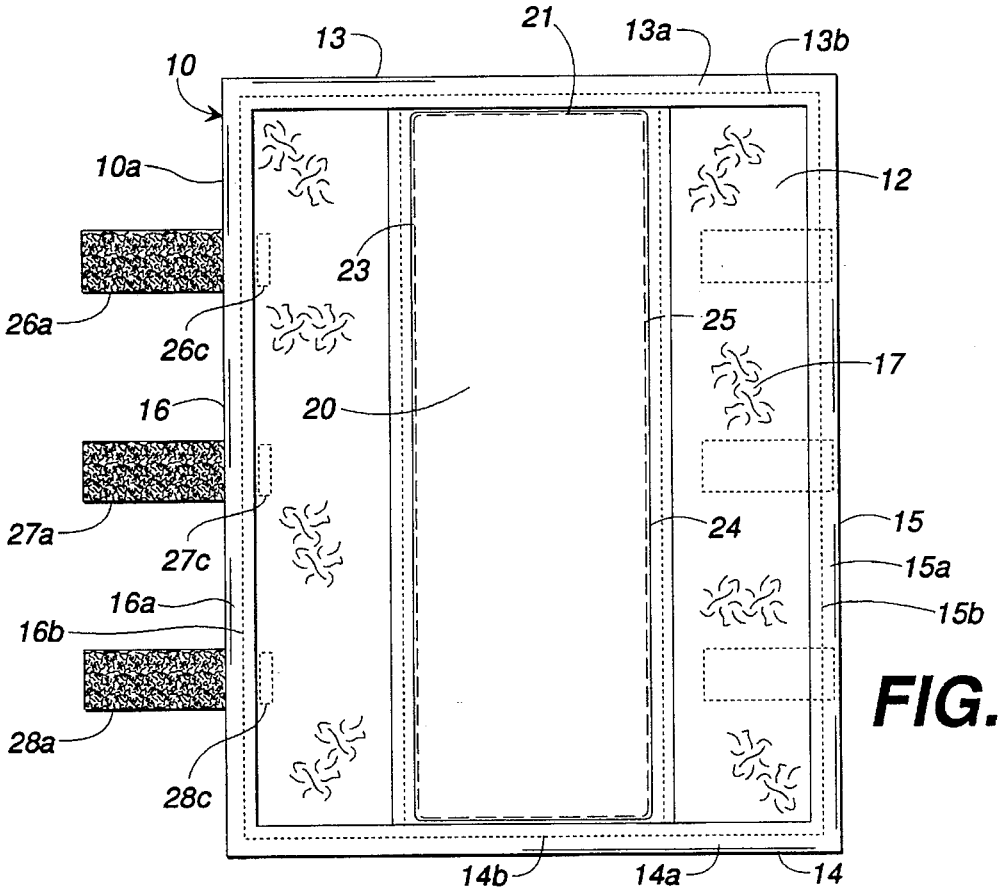
FIG. 4 is a bottom plan view of the legging shown in FIG. 2.

Secured to the outer surface of body 10 are a plurality of opposed pairs of interengagable, releasable, detent tabs or straps 26, 26*a*, 27, 27*a*, and 28, 28*a*, the function of which is to removably retain body 10 looped around a person's leg L so that the side edges 15 and 16 are juxtaposed with respect to each other. These straps 26, 26*a*, 27, 27*a*, and 28, 28*a* are formed preferably of hook and loop, or Velcro®, such as pairs. In more detail, the Velcro® pairs have rectangular hook element tabs 26, 27 and 28 which are adhered or stitched, with stitches 26*b*, 27*b* and 28*b*, as spaced overlays on the outer surface 11 of body 12. As seen in FIG. 2, the hook tabs 26, 27 and 28 are outwardly facing and vertically spaced from each other, the central tab 27 being about midway between upper edge 13 and lower or bottom edge 14. The upper tab 26 and the lower tab 28 are spaced on opposite sides of central tab 27 being about midway between edge 13 and tab 27 and edge 14 and tab 27, as the case may be.

Figure 3:
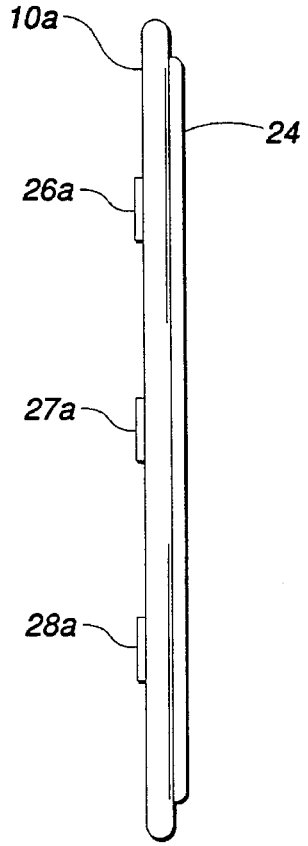
FIG. 3 is a side elevational view of the legging shown in FIG. 2.
Figure 5:
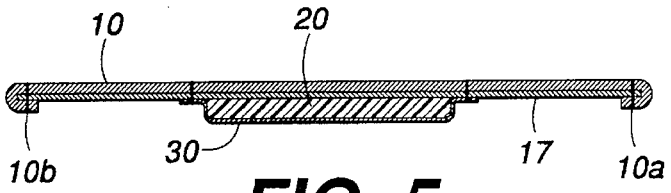
FIG. 5 is a cross-sectional view taken substantially along line 5—5 in FIG. 2.

The loop tabs 26*a*, 27*a* and 28*a* are respectively horizontally aligned with tabs 26, 27 and 28, however, the loop tabs 26*a*, 27*a* and 28*a* have proximal portions which are secured by stitches 26*c*, 27*c* and 28*c* to the body 10 adjacent to side edge 16, whence the distal end portions of tabs 26*a*, 27*a* and 28*a* protrude sidewise outwardly beyond the edge 16, as shown in FIGS. 2 and 3. The lower or inner surfaces of the distal end portions of tabs 26*a*, 27*a* and 28*a* are respectively provided with looped surfaces, which are engaged and yieldably held by the hook portions of tabs 26, 27 and 28 when said distal end portions of tabs 26*a*, 27*a* and 28*a* overlap tabs 26, 27 and 28.

Thus, when the legging, i.e. , the body 10, is wrapped around the leg L as shown in FIG. 1, so that tabs 26*a*, 27*a* and 28*a* overlap tabs 26, 27 and 28, and they are urged into engagement, respectively, with each other, the pairs respectively form friction locks or detents, holding the body 10 in place on leg L while positioning the body 10 so that it holds the shin protector overlay 30 engaged with and aligned with the shin of leg L.

The legging is normally of a length that the upper edge 13 terminates below the knee while lower edge 14 terminates above the ankle. At times, however, the legging can be produced with a length sufficient to cover a portion of a knee and/or ankle.

Hook tabs 26, 27 and 28, as seen in FIG. 2, are each rectangular members and loop tabs 26a, 27*a*, and 28*a* are also rectangular members. Preferably, the central tabs 27, 27*a* are disposed in transversely opposed relationship to each other, essentially midway between the upper and lower edges 13 and 14 so that the distal portion of the tab 27*a* will overlap a portion of web 10, adjacent the edges 15 and 16, respectively. Spaced above tabs 27, 27*a*, are the upper tabs 26, 26*a* which are generally equidistant between the upper edge 13 and the tabs 27, 27*a*.

When properly positioned, the pad 20 covers substantially the entire length of the shin of the lower limb of the leg of a person so as to protect that person against being inadvertently hurt by a stone or rock on which the user kneels. The non-woven polyester or cotton fiber lining 17 will form a cushioning effect against the sides of the person's lower leg so as to prevent chaffing during the movement of the legging 10 with respect to the person's leg.

In a typical legging 10, the web or body 10 will be from approximately 18 inches to 22 inches and preferably 20 inches in length and from approximately 14 inches to 18 inches and preferably 16 inches in width. Furthermore, the Velcro® hook straps or tabs 26*a*, 27*a*, and 28*a*, are preferably about 5 inches long and about 1½ inches wide. In like fashion, the Velcro® straps or tabs 26, 27, and 28 are about 5 inches long and about 1½ inches wide. Indeed, other types of straps can be used.

The foam padding 20 should be from about 16 inches to twenty inches long and preferably about 18 inches long, and about 4 inches to about 6 inches wide and ¼ inch to about ¾ inch thick. The vinyl body should be from about 5 mils. to about 10 mils. and preferably 8 mils. in thickness.

The advantages of the legging of the present invention are that a lawn care maintenance operator can wear shorts and use the legging or leggings to protect his legs. The legging of the present invention will usually be adequate to prevent the leg of the person from being hurt. It prevents a person in short pants from having his legs abraded, reduces workman's compensation claims and prevents lawn chemicals, either liquid or granular, from readily contacting the skin of the person. The legging is easily applied to a person's leg and easily removed. Furthermore, the legging is lightweight, comfortable and is readily adjustable to fit substantially any diameter leg. The legging also protects the leg from being struck by a trimmer line and can be readily installed over the clothing or on the bare skin. The legging is easily folded into a small package. It can, at times, protect the ankle and the knee, if of such a length. The product is washable, inexpensive and durable. The shin protector provides a very satisfactory way of protecting a person's shins against being struck and damaged.

It will be obvious to those skilled in the art that many variations may be made in the embodiment here chosen for the purpose of illustrating the present invention without departing from the scope thereof as defined in the appended claims.

I claim:

1. A legging for being worn by a lawn maintenance person for protecting the person's lower leg, comprising:

(a) a flexible body having an outer surface and an inner surface, a pair of opposed side edges, opposed side edge portions respectively adjacent to said side edges, an upper edge and a lower edge, and a central portion on said inner surface between said opposed side edge portions and said upper and lower edges;

(b) a resilient shin protector disposed longitudinally along said body between and spaced inwardly of said side edges;

(c) a shin protector overlay fixed to said central portion of said inner surface of said body to form a pocket, said pocket between and spaced inwardly of said side edges, said pocket receiving said shin protector and holding said shin protector in essentially a fixed position between and spaced inwardly of said side edges;

(d) a plurality of straps secured to said opposed side edge portions of said body, said straps being interengagable with each other for securing said side edge portions in juxtaposition with respect to each other when said body is passed around said lower leg, said shin protector being aligned with the shin when said body is appropriately positioned around said lower leg.

2. The legging defined in claim 1 wherein said flexible body is rectangular and said shin protector is disposed midway between said side edges.

3. The legging defined in claim 1 wherein said straps are formed from inter engagable hook portions and loop portions, said hook portions being mounted adjacent to one of said side edges and said loop portions protruding sidewise from the other of said side edges for overlapping said hook portions when said legging is wrapped around a person's lower leg.

4. The legging defined in claim 1 wherein said plurality of straps includes a plurality of vertically spaced opposed pairs of straps, the straps on one side extending beyond their adjacent side edge and engaging the straps on the other side, all straps being mounted on the outer surface of said body.

5. The legging defined in claim 1 and wherein said shin protector is a resilient pad that extends substantially the entire distance between said upper edge and said lower edge, said shin protector being disposed midway between said side edges, said side edges being essentially parallel to each other and said upper and said lower edges being essentially parallel to each other, the distance between said upper edge and said lower edge being of a distance such that said body will cover substantially the entire lower leg of said person.

6. The legging defined in claim 1 wherein said overlay is stitched to said body and said straps comprise hook-and-loop type fasteners attached to said body.

7. The legging defined in claim 1 wherein said flexible body is formed of a sheet selected from the group consisting of plastic and canvas.

8. The legging defined in claim 1 wherein said inner surface of said body is provided with a soft inner lining.

9. The legging defined in claim 1 wherein said shin protector is formed of a foamed plastic material.

10. The legging defined in claim 1 wherein said shin protector is an elongated member which is disposed centrally along the inner surface of said body, said shin protector extending substantially the length of said body and terminating inwardly of the upper edge of said body and inwardly of the lower edge of said body.

11. The shin protector defined in claim 1 wherein said straps are formed of opposed pairs of longitudinally spaced hook portions and longitudinally spaced loop portions which, when brought together, removably retain said legging around said leg of said person.

12. The legging defined in claim 1 wherein said body is a vinyl sheet having a thickness from about 5 mils. to about 10 mils., said sheet is from about 18 inches to about 22 inches in length and from about 14 inches to about 18 inches in width, said shin protector being from about 16 inches to about 20 inches in length and about 4 inches to about 6 inches in width and from about ¼ inch to about ¾ inch in thickness.

13. The legging defined in claim 1 wherein said body is a rectangular flexible sheet, and wherein certain of said tabs are secured along one edge portion of said sheet and certain other of said tabs protrude sidewise outwardly of the other edge portion of said sheet for overlapping said first tabs when said sheet is wrapped around said leg of said person.

14. A legging for being worn by a lawn maintenance person for protecting the person's lower leg, consisting essentially of:

(a) a flexible body having an outer surface and an inner surface, a pair of opposed side edges, opposed side edge portions respectively adjacent to said side edges, an upper edge and a lower edge, and a central portion on said inner surface between said opposed side edge portions and said upper and lower edges;

(b) a resilient shin protector disposed longitudinally along said body between and spaced inwardly of said side edges;

(c) a shin protector overlay fixed to said central portion of said inner surface of said body to form a pocket, said pocket between and spaced inwardly of said side edges, said pocket receiving said shin protector and holding said shin protector in essentially a fixed position between and spaced inwardly of said side edges;

(d) a plurality of straps secured to said opposed side edge portions of said body, said straps being interengagable with each other for securing said side edge portions in juxtaposition with respect to each other when said body is passed around said lower leg, said shin protector being aligned with the shin when said body is appropriately positioned around said lower leg.

* * * * *